United States Patent [19]

Zwyssig

[11] Patent Number: 4,774,773

[45] Date of Patent: Oct. 4, 1988

[54] WALL ELEMENT FOR PASTA DRYER

[75] Inventor: Hermann Zwyssig, Gossau, Switzerland

[73] Assignee: Gebrueder Buehler AG, Switzerland

[21] Appl. No.: 865,746

[22] PCT Filed: Sep. 9, 1985

[86] PCT No.: PCT/EP85/00455

§ 371 Date: Apr. 17, 1986

§ 102(e) Date: Apr. 17, 1986

[87] PCT Pub. No.: WO86/01883

PCT Pub. Date: Mar. 27, 1986

[30] Foreign Application Priority Data

Sep. 13, 1984 [CH] Switzerland ..... 4372/84
Oct. 31, 1984 [DE] Fed. Rep. of Germany ..... 3439860

[51] Int. Cl.[4] ..... F26B 25/12

[52] U.S. Cl. ..... 34/201; 34/243 R; 49/40; 49/501; 432/248; 110/173 R

[58] Field of Search ..... 432/250, 248, 252, 237; 110/173 R; 49/40, 501; 34/201, 243 R

[56] References Cited

U.S. PATENT DOCUMENTS 1,891,802 12/1932 Drew ..... 432/250
3,149,477 9/1964 Bivins ..... 49/40
4,254,960 3/1981 Jelinek ..... 49/40

*Primary Examiner*—Larry I. Schwartz
*Attorney, Agent, or Firm*—Darby & Darby

[57] ABSTRACT

In a pasta dryer (1) with an insulation cladding encasing the dryer, the side parts of which cladding consist of individual convex wall elements (10) which can be braced in their edge regions against frame parts (13) of the dryer, the wall elements (10) are of convex design in the shape of a cylinder section and the associated frame parts (13) are adapted correspondingly.

18 Claims, 2 Drawing Sheets

WALL ELEMENT FOR PASTA DRYER

FIELD OF THE INVENTION

The invention relates to a pasta dryer with an insulation cladding encasing the dryer, the side parts of which cladding consist of individual convex wall elements which can be braced in their edge regions against frame parts of the dryer.

BACKGROUND OF THE INVENTION

The insulation cladding of pasta dryers has to meet various requirements. For one thing, any appreciable dissipation of energy through the cladding to the outside is to be prevented. A good insulation effect of cladding also has the consequence that there are correspondingly large temperature differences between the innermost and outermost skins of the cladding, which results in different thermal expansions on the cladding. To prevent air gaps developing between the wall elements, it is known to cover their joints with sealing tapes. However, this practice may, under extreme conditions, result in it only being possible to reseal the wall elements with the use of additional sealing material when fixed during service work following a lengthy time in operation. If, as is often the case today, flat boards are used here for wall elements, the problem indicated becomes even more difficult because the dimensional stability of these boards is less.

To achieve a better dimensional stability of the wall elements, wall elements having a slight convexity (large radius) in their middle region and provided with a greater curvature (smaller radius) at their edge regions (upper and lower end regions) have already been used, whereby an improved dimensional stability could be achieved. However, with these wall elements there is the risk that, not least also on account of the different curvature of the wall elements, uneven distributions of stresses may occur over the overall cross-section of the wall elements when there are substantial differences in temperature, leading to the risk of cracks forming.

In this situation, the invention is based on the object of fitting a pasta dryer with such insulation cladding that it results in an equalization of the stress distribution over the overall cross-section of the wall elements even when large temperature differences occur between inside and outside of the dryer, and thus in a reduced risk of cracks occurring. However, it is also the particular intention that quick removal and reattachment of the wall elements as often as desired for carrying out service work should be possible without any problems.

According to the invention, this object is achieved in the case of a pasta dryer of the type stated at the start by the wall elements being of convex design in the shape of a cylinder section and the associated frame parts being adapted accordingly.

It has been shown surprisingly that the measures according to the invention result in a surprisingly dimensionally stable behavior of the wall elements even with extreme temperature changes and large temperature differences and that, obviously owing to a noticeable equalization of the stress distribution over the area of the wall elements, it has been possible to reduce distinctly the risk of the undesired formation of cracks. Compared with the previously known wall elements, which were provided with an increased curvature in their edge regions, with the pasta dryer according to the invention there was also always a very effective sealing contact between the wall elements and the associated frame parts even if substantial temperature differences occurred. Thus, in the case of the invention, the use of additional sealing tapes can be dispensed with entirely, which is virtually impossible in the case of known dryers and also means that there may no longer be the necessity of renewing the seals after carrying out service work. It has proven advantageous to provide the wall elements with a uniform wall thickness over their entire area.

In the case of the invention, the wall elements are preferably lined on their side facing the inside of the dryer with a plate, again preferably made of thin metal sheet, loosely inserted into the bow shape as a vapor barrier. Depending on the type of operation, for example a 0.5 to 1 mm thick plate of, for example, stainless sheet steel may be inserted in this case without any rigid fixing on the inside of the particular wall element. Such a sheet steel plate proves in practice to be an effective vapor barrier, at the same time adapting without difficulty and completely of its own accord to the curvature of the wall element when inserted, as it has an appropriate flexibility over its entire area. This has the advantage that there is no need for any special working of the vapor barrier since, as already mentioned, the metal sheet easily adapts to the convex shape of the inside of the wall element (it should be borne in mind in this connection that these wall elements have a lengh and radius of curvature of an order of magnitude of 1 to 3 m). In this respect, care has to be taken merely that a suitable retaining fixture for such a plate as a vapor barrier is provided on the inside of the wall element, although this does not concern a retaining fixture by means of which the steel sheet is rigidly fixed to the wall element. Rather, such a retaining fixture is to be provided in which the sheet steel plate is only inserted and in which it can still expand or contract when temperature differences occur: the retaining fixture merely has to ensure that the inserted steel plate is adequately retained with respect to the wall element, for instance at its outer periphery, so that it cannot fall away from the wall element again. In the case of the invention, this can be performed for example in a particularly advantageous way by such a wall element being provided on its entire outer periphery on its inside (i.e. the side of the wall element facing the inside of the dryer) with a profiled seal, for instance a rubber profile, which is arranged in such a way that the plate-shaped vapor barrier is supported with respect to the wall element. In this case, it is also advantageous if the plate-shaped vapor barrier does not protrude laterally beyond such a profiled seal, for instance a rubber seal, (i.e. so that the rubber seal is arranged around the edge region of the wall element in such a way that the plate-shaped vapor barrier surrounded by the seal in its bordering edge region does not protrude by its lateral edges beyond the area enclosed by the seal). As the vapor barrier is only inserted into the retaining fixture, but is not to be connected to it rigidly with respect to the wall element, as consequently there is no fixed (rigid) connection between vapor barrier and wall element, the vapor barrier can also expand or contract independently of the wall element under the influence of temperature without undesired compulsive stresses occurring and yet is always retained adequately well by the profiled seal with respect to the wall element. The occurrence of undesired compulsive stresses may be avoided virtually completely in this case, which represents a quite substantial advantage over known constructions.

A further advantageous development of the invention consists in that the wall elements consist of foamed plastic or another insulating material which has a resistant outer skin, the outer skin of the wall element facing the inside of the dryer being provided with one or more grooves. The grooves, for instance in the form of depressions two to six fingers deep arranged distributed over the surface, produce not only a further dimensional reinforcement of the wall element concerned, but also make possible at the same time a reduction in the linear changes of the outer dimensions occurring on the inside of the wall (for instance due to higher temperatures), whereby it may be achieved that virtually no undesired thermal stresses occur any longer. As these grooves are completely covered by the vapor barrier (metal sheet), they do not produce any dirt traps either, which also permits quick and thorough cleaning of such a dryer.

A further advantageous development of the invention also consists in that each wall element is suspended at its upper side on hinges and can be pressed by means of tension elements arranged on its lower side against the corresponding frame parts, it being particularly advantageous if hinges are arranged in each case directly (vertically) above the tension elements. This makes possible further expedient practical handling when carrying out service work. At the same time, it is achieved that the respective convex wall element already bears well against the corresponding frame parts of the pasta dryer under its own weight, without the application of any additional force. By means of the tension elements, a completely tight finish around the entire periphery of the vapor barrier (wall element) can be ensured with only slight deformation of the sealing profile, and hence even when slight production inaccuracies occur.

Preferably, each wall element is assigned a support arm which is fixed on the frame part and can be folded down. If cleaning or other service work is to be carried out, two or three quick-acting closures can be opened quickly with few manipulations, the wall element pulled away at the bottom with one hand and the support arm, which holds it in an open position, moved into the desired position with the other hand. This makes it possible to reduce idle times noticeably compared with known solutions.

It is, furthermore, advantageous if the wall elements are designed with the same wall thickness over their entire area. As a vapor barrier can be inserted on the inside, the qualitative design of the wall elements and also the thickness of the insulating material of the wall elements can be chosen appropriately to meet other requirements, independently of the vapor barrier.

BRIEF DESCRIPTION OF THE DRAWINGS

The principle of the invention is explained in more detail below in an exemplary embodiment with reference to the drawing, in which.

DETAILED DESCRIPTION

Figure 1:
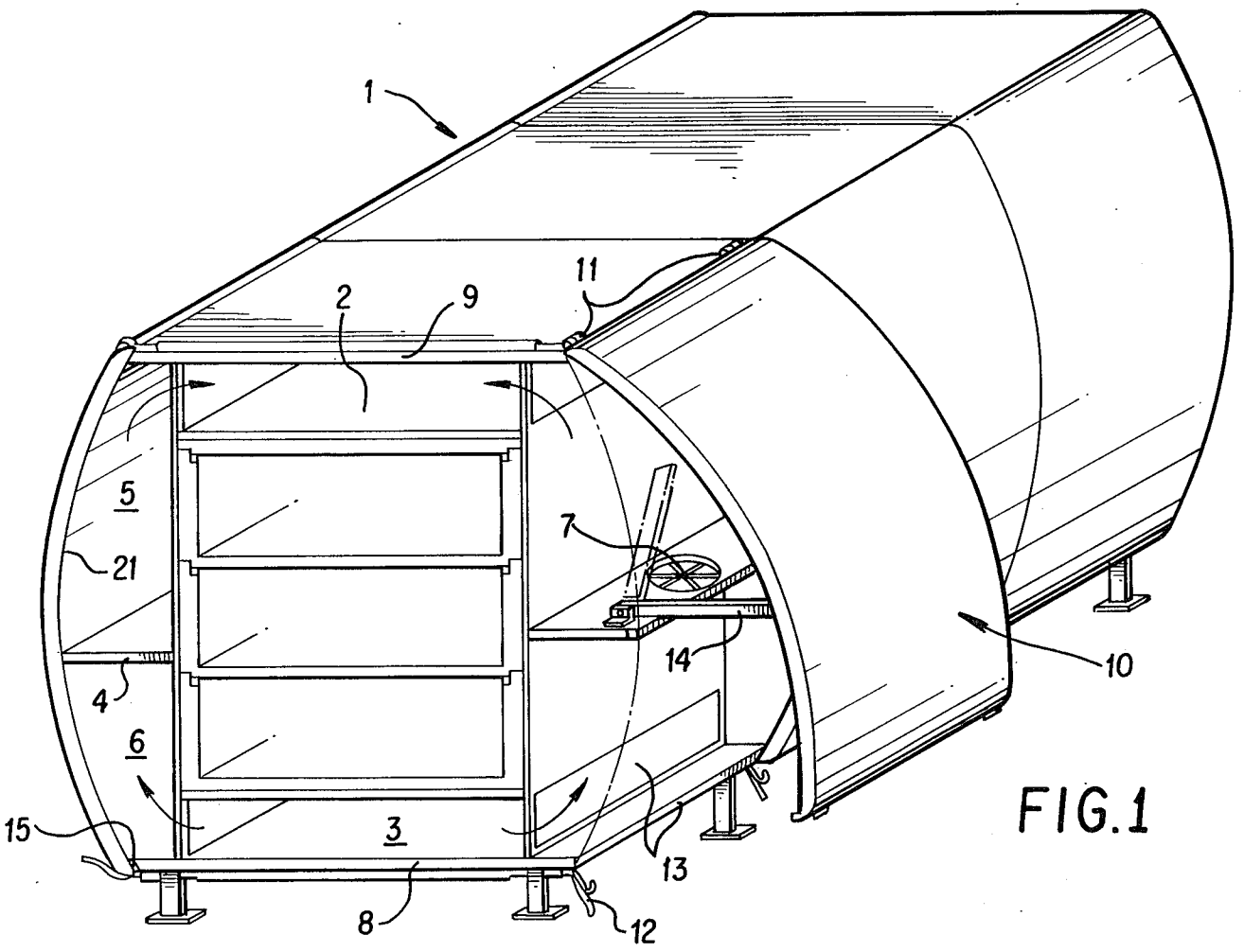
FIG. 1 shows a perspective representation of a pasta dryer according to the invention.

The typical pasta dryer 1 shown in FIG. 1 has an opened front end. Inside it, conveying means (not illustrated), for instance bar transport systems, a belt or vibration conveyor etc., are to be arranged, which are not shown in the drawing, however, for the sake of clarity of representation. In FIG. 1, merely three conveying levels arranged one above the other are illustrated. Each of two air distribution spaces 2 and 3 extend over the entire length of the pasta dryer 1. On either side of the same are provided an upper and a lower circulation space 5 and 6 respectively, separated by a partition 4, the air movement being forced by an adequate number of fans 7. There are likewise heating-cooling and other thermal elements, but these are not illustrated in detail in FIG. 1.

The pasta dryer 1 is surrounded at top and bottom by flat insulating boards 8 and 9 and at the side by preshaped convex wall elements 10, the latter having a bow shape in the form of a cylinder section (i.e. they are curved with a constant radius over their height). The wall elements 10 are fixed at the top in each case by two hinges 11 on the frame parts 13 (a forward lying frame part 13 adapted to the curvature of the wall element 10 is illustrated only in dot-dashed lines in FIG. 1). On their lower side, the wall elements 10 can be pressed tightly against the frame parts 13 provided there by means of two quick-acting closures 12, whereby each wall element, which may be opened upward like a door, can also easily be swung outward again after releasing the quick-acting closures 12. In this arrangement, the frame elements 13 are all adapted to the corresponding shape of the wall elements 10. While, in the case of the frame parts 13 running from top to bottom, as shown by dot-dashed lines in FIG. 1, this results in a corresponding curvature of the frame part 13 there corresponding to the inner curvature of the wall element 10, for the frame parts 13 lying at the bottom in the longitudinal direction of the dryer this means that their end edges, against which the wall elements 10 are pressed at the bottom, have a shape adapted to the curvature at least over the edge area.

As shown in FIG. 1, the wall element 10 concerned can be retained without difficulty in opened position by a pivotable support arm 14, which may be folded down. Cleaning, service and inspection work may then be carried out unhindered inside the pasta dryer 1. Subsequently, a quick reclosure is possible without difficulties.

Figure 2:
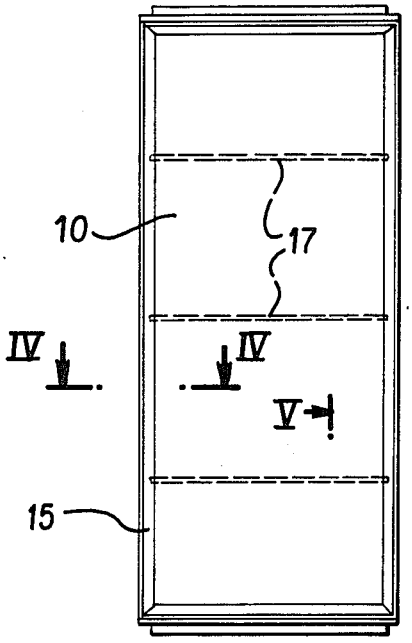
FIG. 2 shows an inside view of a wall element on a pasta dryer according to the invention.

In FIG. 2, a wall element 10 is illustrated in a view from the inside of the dryer. Along the outer edge of the inside area runs a rubber profiled seal 15 outside around the wall element and is held in place by means of a retaining plate 16 (cf. FIGS. 4 and 5). Three horizontal grooves 17 (cf. FIG. 2) ensure that undesired thermal expansions between the inner skin 18 and the outer skin 19 (FIGS. 2 and 5) can be intercepted in wall area portions of only short extent. As well as a wear-resistant outer skin 18 and 19, (formed for instance from a wear-resistant outer layer synthetic resin), the wall element 10 has inside it an insulating material 20 for which, depending on the desired requirements, a foamed plastic with glass fibre reinforcement or another suitable effective insulating material may be chosen.

Figure 4:
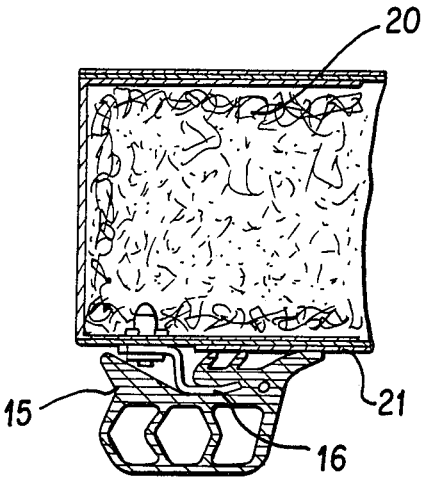
FIG. 4 shows the section IV—IV from FIG. 2.
Figure 5:
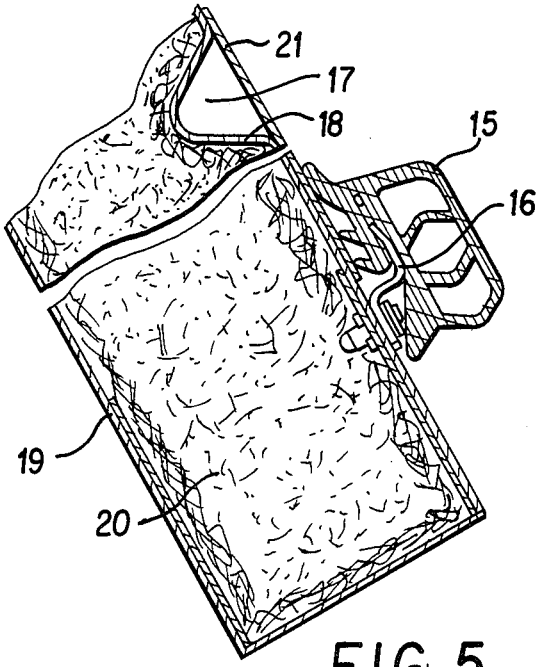
FIG. 5 shows the section V—V from FIG. 2.

Furthermore, a metal plate 21 held by the sealed profile 15 and loosely inserted in a retaining fixture on the concavity of the wall element 10 (FIGS. 4 and 5) serves as vapor barrier and in particular also represents a screen against the temperature of the inside of the dryer. The metal plate 21, for instance in the form of a thin stainless metal sheet, is in this case inserted in a loose manner, as is shown in detail for instance in FIG. 4 or FIG. 5, it being pointed out here that the graphic representation there is expressly essential: as can be seen in FIGS. 4 and 5, the vapor barrier 21 is, in its outer region, pressed by the profiled seal 15 against the outer skin 18 there of the wall element 10. In this arrangement, the vapor barrier 21 extends between the seal 15 and the outer skin 18 and is pressed against the outer skin 18 by the seal 15, which for its part is borne by a retaining clip 16 fixed on the wall element 10. This achieves an adequately firm retention which reliably prevents the plate-shaped vapor barrier 21 being able to fall out of this retaining fixture (which is arranged moreover all round the vapor barrier 21). However, the plate-shaped vapor barrier 21 under the rubber seal 15 is not obstructed from undergoing any expansion or contraction which may be induced by thermal stresses, i.e. it can expand or contract unimpeded in its longitudinal direction, that is parallel to the surface of the outer skin 18, in spite of a continuing pressing effect of the rubber seal 15. Thus, owing to this loose retention fixture chosen, the metal plate 21 may expand or contract virtually unhindered without undesired compulsive stresses occurring in it as a result. Also, no deviation in its convex shape occurs, which the metal plate assumed when inserted in the retaining fixture and which corresponds to the concavity of the wall element 10. As long as the metal plate 21 is retained in its outer edge region against slipping, it can also no longer fall out of the bordering fixture, even with the wall element open. Further, in the configuration illustrated, the metal plate 21 does not protrude laterally beyond the rubber seal 15, i.e. toward the side of the rubber seal 15 which does not face the area of the metal plate surrounded by the rubber seal 15: this prevents effectively the possibilty of an undesired heat bridge to the outside being produced.

Figure 3:
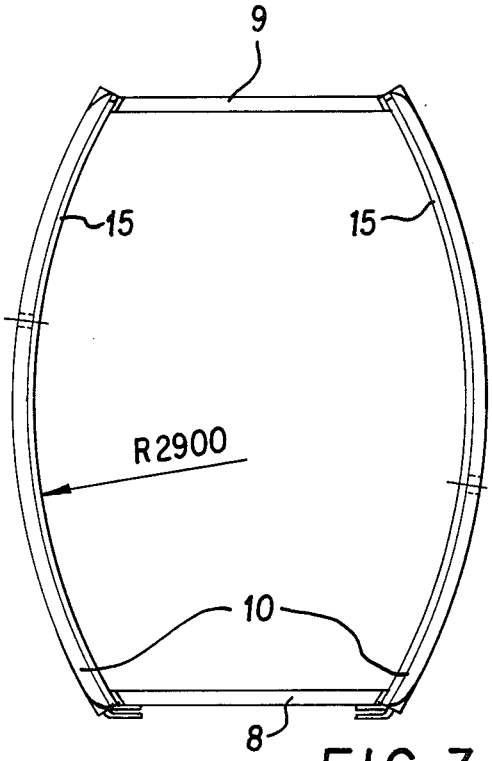
FIG. 3 shows a diagrammatic side view of an insulation cladding or a pasta dryer according to the invention.

In FIG. 3, the reference symbol R is intended to specify that the convexity of the wall element has the same radius R (of for example 1 to 3 m) over its entire height. Even in the case of great temperature differences of up to 100° C. or more, linear changes occurring in the retaining element can hardly alter the size of this radius R, which means that the plate 21 is also always held in a completely tight position via the hinges 11 and the quick-action closures 12.

The embodiment of a dryer shown in the figures has a surprisingly high dimensional stability, both in cold and in hot condition. At the same time, the metal plate 21 has proven to be a fully satisfactory vapor barrier and virtually no air losses occur even with slight air pressure inside the pasta dryer. The pasta dryer shown can be cleaned virtually optimally and has, outwardly too, a particularly attractive shape.

The invention also concerns a process for the simple and effective lining of the wall elements with a vapor barrier by loose insertion of a thin, vapor-impermeable sheet or other suitable thin, flexible, plate-shaped material in an edge retaining fixture attached on the inside of the wall element (with the effect that this thin vapor barrier adapts of its own accord to the convexity of the retaining element and can move freely relative to the wall element within the retaining fixture, even under the influence of temperature, although it is otherwise retained effectively by the retaining fixture). This makes it possible for the first time to produce in an inexpensive, quick and simple way an edge element with effective vapor barrier and without the occurrence of undesirably high compulsive stresses when there are large temperature differences and the risk caused thereby of crack formation.

I claim:

1. A pasta dryer comprising an insulation cladding encasing the dryer and having individual convex wall elements which have edge regions, said dryer having frame parts against which said edge regions are braced, the convex wall elements being in the shape of a cylinder section and the associated frame parts against which said edge regions are braced being shaped to conform to said edge regions, the wall elements being lined on their side facing the inside of the dryer with a plate loosely inserted into the convex shape as a vapor barrier.

2. The pasta dryer as claimed in claim 1, wherein the vapor barrier comprises a thin metal sheet.

3. The pasta dryer as claimed in claim 1, wherein each wall element is provided along the entire periphery on its inside with a rubber profile which at the same time serves as a support for the vapor barrier.

4. The pasta dryer as claimed in claim 3, wherein the vapor barrier does not protrude laterally beyond the rubber profile.

5. The pasta dryer as claimed in claim 1, wherein the wall elements are of uniform thickness over their entire area.

6. The pasta dryer as claimed in claim 2, wherein each wall element is provided along the entire periphery on its inside with a rubber profile which at the same time serves as a support for the vapor barrier.

7. The pasta dryer as claimed in claim 2, wherein each wall element is provided along the entire periphery on its inside with a rubber profile which at the same time serves as a support for the vapor barrier.

8. The pasta dryer as claimed in claim 1, wherein each wall element has an upper and lower end, is suspended at its upper end on hinges and includes tension elements arranged on its lower end, by means of which it is pressed against the corresponding frame parts.

9. The pasta dryer as claimed in claim 2, wherein each wall element has an upper and lower end, is suspended at its upper end on hinges and includes tension elements arranged on its lower end, by means of which it is pressed against the corresponding frame parts.

10. The pasta dryer as claimed in claim 3, wherein each wall element has an upper and lower end, is suspended at its upper end on hinges and includes tension elements arranged on its lower end, by means of which it is pressed against the corresponding frame parts.

11. The pasta dryer as claimed in claim 4, wherein each wall element has an upper and lower end, is suspended at its upper end on hinges and includes tension elements arranged on its lower end, by means of which it is pressed against the corresponding frame parts.

12. The pasta dryer as claimed in claim 1, further comprising at least one support arm which is mounted on a frame part so as to be capable of being folded down, each arm being constructed to coact with the associated wall element.

13. The pasta dryer as claimed in claim 2, further comprising at least one support arm which is mouted on a frame part so as to be capable of being folded down, each arm being constructed to coact with the associated wall element.

14. A pasta dryer comprising an insulation cladding encasing the dryer and having individual convex wall elements which have edge regions, said dryer having frame parts against which said edge regions are braced, the convex wall elements being in the shape of a cylinder section and the associated frame parts against which said edge regions are braced being shaped to conform to said edge regions, the wall elements being made of insulating material and a resistant outer skin, the outer skin facing the inside of the dryer having at least one groove.

15. The pasta dryer as claimed in claim 14, wherein the wall elements are made of foamed plastic.

16. The pasta dryer as claimed in claim 14, wherein each wall element has an upper and lower end, is suspended at its upper end on hinges and includes tension elements arranged on its lower end, by means of which it is pressed against the corresponding frame parts.

17. A pasta dryer comprising an insulation cladding encasing the dryer and having individual convex wall elements which have edge regions, said dryer having frame parts against which said edge regions are braced, the convex wall elements being in the shape of a cylinder section and the associated frame parts against which said edge regions are braced being shaped to conform to said edge regions, each wall element having an upper and lower end, being suspended at its upper end on hinges and including tension elements arranged on its lower end, by means of which it is pressed against the corresponding frame parts.

18. The pasta dryer as claimed in claim 11, wherein the hinges are arranged substantially vertically above respective tension elements.

* * * * *